US005102763A

United States Patent [19]

Winnik et al.

[11] Patent Number: 5,102,763

[45] Date of Patent: Apr. 7, 1992

[54] TONER COMPOSITIONS CONTAINING COLORED SILICA PARTICLES

[75] Inventors: Francoise M. Winnik, Toronto, Canada; David J. Luca, Rochester; Thomas W. Smith, Penfield, both of N.Y.

[73] Assignee: Xerox Corporation, Stamford, Conn.

[21] Appl. No.: 495,669

[22] Filed: Mar. 19, 1990

[51] Int. Cl.[5] ..... G03G 9/00; G03G 5/00

[52] U.S. Cl. ..... 430/110; 430/109; 430/106; 430/137

[58] Field of Search ..... 430/106, 106.6, 109, 430/110, 137

[56] References Cited

U.S. PATENT DOCUMENTS

| | | | |
|---|---|---|---|
| 2,876,119 | 3/1959 | Dithmar et al. | 106/20 |
| 2,993,809 | 7/1961 | Bueche et al. | 117/100 |
| 3,290,165 | 12/1966 | Iannicelli | 106/308 |
| 3,834,924 | 9/1974 | Grillo | 106/308 N |
| 3,939,087 | 2/1976 | Vijayendran et al. | 252/62.1 L |
| 4,179,537 | 12/1979 | Rykowski | 427/387 |
| 4,204,871 | 5/1980 | Johnson et al. | 106/20 |
| 4,566,908 | 1/1986 | Nakatani et al. | 106/308 N |
| 4,576,888 | 3/1986 | Miyakawa et al. | 430/106 |
| 4,592,989 | 6/1986 | Smith et al. | 430/110 |
| 4,680,200 | 7/1987 | Sole | 427/213.34 |
| 4,681,829 | 7/1987 | Grushkin | 430/109 |
| 4,820,604 | 4/1989 | Manca et al. | 430/110 |
| 4,837,391 | 6/1989 | Anderson et al. | 430/110 |
| 4,877,451 | 10/1989 | Winnik et al. | 106/23 |

OTHER PUBLICATIONS

Journal of Chromatography, 299(1984) 175–183, "Preparation and Analysis of Reactive Blue 2 Bonded to Silica via Variable Spacer Groups".

*Primary Examiner*—Marion E. McCamish
*Assistant Examiner*—Stephen C. Crossan
*Attorney, Agent, or Firm*—Judith L. Byorick

[57] ABSTRACT

Disclosed is a dry toner composition which comprises a resin, hydrophilic silica particles having dyes covalently bonded to the particle surfaces through silane coupling agents, and a polymer having at least one segment capable of enhancing the dispersability of the silica particles in the resin and at least one segment capable of adsorbing onto the surface of the silica particles. In one embodiment, the polymer segment capable of adsorbing onto the surface of the silica particles is ionophoric and capable of complexing with a salt, thereby incorporating a toner charge control additive into the polymer.

32 Claims, No Drawings

TONER COMPOSITIONS CONTAINING COLORED SILICA PARTICLES

BACKGROUND OF THE INVENTION

The present invention is directed to dry toner compositions suitable for the development of electrostatic images. More specifically, the present invention is directed to dry toner compositions containing colored silica particles and polymers with at least two different blocks or segments. One embodiment of the present invention is directed to a dry toner composition comprising a resin, hydrophilic silica particles having dyes covalently bonded to the particle surfaces through silane coupling agents, and a polymer having at least one segment capable of adsorbing onto the surface of the silica particles and at least one segment capable of enhancing the dispersability of the silica particles in the resin. In another embodiment of the present invention, one segment of the polymer is ionophoric and capable of complexing with a salt, thereby imparting charge control agent properties to the composition.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Electrophotographic processes can be employed to form colored images. For example, the formation of highlight color images, wherein documents are generated containing separate image areas of two or more different colors, is well known. In addition, the formation of full color images, wherein documents are generated containing full color images by sequentially forming and developing images with cyan, magenta, yellow, and optionally black toners, is well known. High quality color toners are desirable for both applications, and toners with a high degree of transparency and good color mixing are particularly desirable for full color copying and printing processes. Transparent colored toners, by which is meant colored toners in which light scattering is minimized as light passes through images developed with the toners, are generally obtained either by employing a dye molecularly dispersed in the toner resin as a colorant or by employing very finely divided pigment particles, generally with an average particle diameter of about 50 nanometers or less, uniformly dispersed in the toner resin as a colorant.

Electrophotographic toners containing colored silica particles are known. For example, U.S. Pat. No. 4,566,908 discloses an azoic pigment suitable for use in an electrophotographic toner having a silica core comprising a core of a fine powder of silica having a particle diameter of not more than 10 microns and a coating of a mono- or polyazoic dye chemically bound to the surface of the silica core through an aminosilane coupling agent. The process for preparing these colored silica particles is detailed at columns 8 to 18 of the patent. In addition, U.S. Pat. No. 4,576,888 discloses a toner for electrophotography comprising an azoic pigment having a silica core as a coloring component, the azoic pigment comprising a core of a fine powder of silica and a coating of a mono- or polyazoic dye chemically bound to the surface of the silica core through an aminosilane coupling agent. Further, R. Ledger and E. Stellwagen, "Preparation and Analysis of Reactive Blue 2 Bonded to Silica Via Variable Spacer Groups," *Journal of Chromatography*, vol. 299, pages 175 to 183 (1984), discloses processes for preparing colored silica particles by covalently attaching Reactive Blue 2 dye to silica particles through various spacer groups. The disclosure of this article is totally incorporated herein by reference.

Additionally, U.S. Pat. No. 3,290,165 discloses processes for preparing finely divided particulate inorganic pigments modified with amino organosilanes. The modified pigments are suitable for use as fillers for thermosetting resins or as fillers for paper, paints, varnishes, inks, and paper coating compositions. The modified pigments can also be dyed with direct dyes for use as color-imparting fillers. Further, U.S. Pat. No. 3,834,924 discloses a process for producing surface modified finely divided inorganic pigments by addition of an organosilane to a high solids content aqueous dispersion of an inorganic pigment in a mixing apparatus to yield a thick, flowable plastic-type mass suitable for extrusion and drying.

Further, U.S. Pat. No. 4,592,989, the disclosure of which is totally incorporated herein by reference, discloses a toner comprising resin particles, pigment particles, and a complex of a dipolar molecule or salt attached to an ionophoric polymer. The ionophoric polymer can be a polyether diblock copolymer, such as styrene/ethylene oxide diblock polymers.

In addition, U.S. Pat. No. 4,680,200 discloses a process for preparing a colloidal size particulate wherein colloidal size particles of an organic solid such as a pigment are encapsulated in a hydrophobic addition polymer, such as a polymer of styrene, by a polymerization addition process wherein a water-immiscible (hydrophobic) monomer is dispersed in an aqueous colloidal dispersion of the organic particles and subjected to conditions of emulsion polymerization. The resulting encapsulated particles are useful in toners and as pigments.

U.S. Pat. No. 4,681,829 discloses a positively charged single component toner comprising resin particles, monoazo or substituted perylene pigment particles, and a charge enhancing additive, as well as additive particles such as colloidal silica or low molecular weight waxes. In addition, U.S. Pat. No. 4,820,604 discloses a toner comprising resin particles, pigment particles, and a sulfur containing organopolysiloxane wax.

Additionally, U.S. Pat. No. 4,877,451, the disclosure of which is totally incorporated herein by reference, discloses ink jet inks comprising water, a solvent, and a plurality of colored particles comprising hydrophilic silica particles to the surfaces of which dyes are covalently bound through silane coupling agents. In addition, of background interest are U.S. Pat. No. 2,876,119;

U.S. Pat. No. 2,993,809; U.S. Pat. No. 3,939,087; U.S. Pat. No. 4,179,537 and U.S. Pat. No. 4,204,871.

Copending application U.S. Ser. No. 07/369,003 entitled "Inks and Liquid Developers Containing Colored Silica Particles," with the named inventors Francoise M. Winnik, Barkev Keoshkerian, Raymond W. Wong, Stephan Drappel, Melvin D. Croucher, James D. Mayo, and Peter G. Hofstra, discloses ink jet inks comprising a liquid medium and a plurality of colored silica particles and liquid electrophotographic developers comprising a liquid medium, a charge control agent, a resin, and a plurality of colored silica particles.

It has been observed that while colored hydrophilic silica particles disperse well in hydrophilic resins, such as polyvinylpyrrolidinone or polyvinyl alcohol, they tend to disperse poorly and aggregate irreversibly in typical toner resins, such as polyester resins, styrene-butadiene resins, styrene-acrylate and styrene-methacrylate resins, and the like. Resins such as polyvinylpyrrolidinone or polyvinyl alcohol, however, typically are not selected as toner resins because they are hydrophilic and their triboelectric properties may change significantly with changes in ambient relative humidity. These resins also can exhibit considerable hydrogen bonding, which may adversely affect melt flow characteristics. Further, hydrophilic resins such as polyvinylpyrrolidinone and the like generally do not exhibit physical and rheological properties usually desired for toner resins, and may be difficult to process into toners by conventional methods such as extrusion and attrition. Accordingly, although the above described compositions and processes are suitable for their intended purposes, a need continues to exist for dry electrophotographic toners available in a wide variety of colors. In addition, a need continues to exist for simple and economical processes for preparing colored particles suitable for dry electrophotographic toners. Further, there is a need for dry toner compositions wherein the particle size and particle size distribution of the colorant particles can be well controlled. There is also a need for dry colored toner compositions with a high degree of transparency, thereby enhancing color quality and enabling the formation of high quality full color images by sequentially applying images of primary colors to a single substrate, each successive image being applied on top of the previous image. A further need exists for dry colored toner compositions containing colored silica particles that are uniformly dispersed in the toner resin. In addition, there is a need for dry colored toner compositions containing silica particle colorants wherein a polymer-salt complex adsorbed onto the silica particles functions as a charge control agent. A need also exists for dry colored toner compositions containing mixtures of silica particles of two or more different colors, resulting in a toner of a desired color. Also, there is a need for dry toner compositions with colorants of low toxicity. There is a further need for dry toner compositions with silica particle colorants of relatively small particle size wherein the silica particles are well dispersed in the resin with minimal or no particle agglomeration, thereby resulting in enhanced toner transparency and color quality.

SUMMARY OF THE INVENTION

It is an object of the present invention to provide dry electrophotographic toners available in a wide variety of colors.

It is another object of the present invention to provide simple and economical processes for preparing colored particles suitable for dry electrophotographic toners.

Yet another object of the present invention is to provide dry toner compositions wherein the particle size and particle size distribution of the colorant particles can be well controlled.

Still another object of the present invention is to provide dry colored toner compositions with a high degree of transparency, thereby enhancing color quality and enabling the formation of high quality full color images by sequentially applying images of primary colors to a single substrate, each successive image being applied on top of the previous image.

Another object of the present invention is to provide dry colored toner compositions containing colored silica particles that are uniformly dispersed in the toner resin.

It is another object of the present invention to provide dry colored toner compositions containing silica particle colorants wherein a polymer-salt complex adsorbed onto the silica particles functions as a charge control agent.

It is still another object of the present invention to provide dry colored toner compositions containing mixtures of silica particles of two or more different colors, resulting in a dry toner of a desired color.

It is yet another object of the present invention to provide dry toner compositions with colorants of low toxicity.

Still another object of the present invention is to provide dry toner compositions with silica particle colorants of relatively small particle size wherein the silica particles are well dispersed in the resin with minimal or no particle agglomeration, thereby resulting in enhanced toner transparency and color quality.

These and other objects of the present invention are achieved by providing a dry toner composition comprising a resin, hydrophilic silica particles having dyes covalently bonded to the particle surfaces through silane coupling agents, and a polymer having at least one segment capable of adsorbing onto the surface of the silica particles and at least one segment capable of enhancing the dispersability of the silica particles in the resin. Another embodiment of the present invention is directed to a dry toner composition comprising a resin, hydrophilic silica particles having dyes covalently bonded to the particle surfaces through silane coupling agents, and a polymer having at least one segment exhibiting miscibility in the resin and at least one ionophoric segment capable of complexing with a salt and capable of adsorbing onto the surface of the silica particles. Still another embodiment of the present invention is directed to two component developer compositions comprising the toners of the present invention and carrier particles. Yet another embodiment of the present invention is directed to a process for preparing a dry toner which comprises preparing in a first solvent a dispersion of hydrophilic silica particles having dyes covalently bonded to the particle surfaces through silane coupling agents, preparing in a second solvent a solution of a polymer having at least one segment capable of enhancing the dispersability of the silica particles in the resin and at least one segment capable of adsorbing onto the surface of the silica particles, admixing the silica particle suspension with the polymer solution, thereby resulting in the polymers adsorbing to the surfaces of the silica particles, isolating the silica particles with the polymers adsorbed thereon from the solution, and admixing the silica particles with the polymers adsorbed thereon with a resin to form a dry toner composition. A further embodiment of the present invention is directed to an imaging process which comprises forming a latent image on an imaging member, developing the latent image with a dry toner of the present invention, transferring the developed image to a suitable substrate such as paper or transparency material, and affixing the transferred image to the substrate.

The dry toner compositions of the present invention generally comprise a toner resin, colored silica particles, and at least one polymer containing a block or segment with an affinity for the toner resin and a block or segment with an affinity for the colored silica particles. Mixing the colored silica particles with the polymer prior to mixing the particles with the toner resin results in greatly enhanced dispersion of the colored silica particles in the toner resin.

The dry electrophotographic toners of the present invention contain colored silica particles. These colored particles can be prepared from hydrophilic silicas. Hydrophilic silicas are generally colorless, and possess surfaces covered with silanols that react with many functional groups to form covalent linkages. To effect coloration of these silicas, the silica is first reacted with a hydroxyalkyl silane or aminoalkyl silane coupling agent to attach the linking agent to the silica surface. Subsequently, a reactive dye is reacted with the linking agent to yield silica particles covalently attached to a dye through a coupling agent. The dye, being covalently bound to the coupling agent, is not subject to leaching or separating from the particles, which reduces or eliminates toxicity of the bound dye compositions. A typical reaction sequence is shown schematically below:

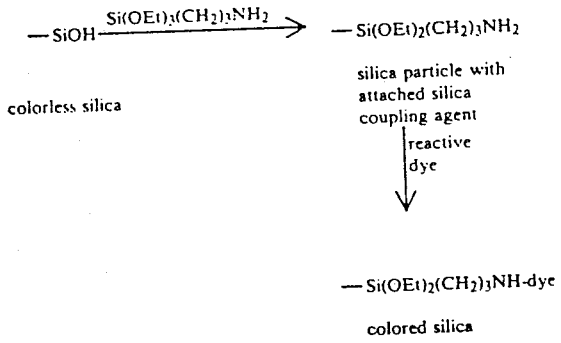

This reaction sequence illustrates the reaction of silica with 3-aminopropyltriethoxysilane to yield silica having covalently attached thereto a 3-aminopropyltriethoxysilane group, which is then reacted with a reactive dye to yield a silica particle having covalently attached thereto a 3-aminopropyltriethoxysilane group, to which is covalently attached a reactive dye.

Suitable silicas are hydrophilic in nature and include fumed silicas and silicas prepared by the sol-gel process. In general, the fumed silica particles are of the class prepared industrially at high temperatures by the reaction of tetrachlorosilane with hydrogen, oxygen, and water, as disclosed by E. Wagner and H. Brunner, *Angew. Chem.*, vol. 72, page 744 (1960), the disclosure of which is totally incorporated herein by reference. The particles have high surface areas of from about 130 to about 380 square meters per gram and primary particle sizes of from about 10 nanometers to about 20 nanometers. These primary particles cluster into aggregates ranging in size from about 50 to about 500 nanometers. Another type of suitable silica is that obtained by the sol-gel process, in which a soluble tetraalkoxysilane is treated with a base in a water/alcohol mixture, as described in W. Stöber, A. Fink, and E. Bohn, *J. Colloid. Int. Sci.*, vol. 20, page 62 (1968), the disclosure of which is totally incorporated herein by reference. The particles prepared by the sol-gel process are monodisperse in size, with average diameters ranging from about 40 nanometers to about 1 micron and surface areas ranging from 40 to 70 square meters per gram. Silica particle size remains essentially unchanged after the reactions with the coupling agent and the dye. Examples of suitable silicas include Aerosil® 200, which has a surface area of 200 square meters per gram, and Aerosil® 380, which has a surface area of 380 square meters per gram, both available from Degussa, Aerosil® 90, Aerosil® 130, Aerosil® 150, Aerosil® 300, Aerosil® OX50, Aerosil® TT600, Aerosil® MOX 80, and Aerosil® MOX 170, all available from Degussa, and Cabosil® L90, Cabosil® LM130, Cabosil® LM5, Cabosil® M-5, Cabosil® PTG. Cabosil® MS-55, Cabosil® HS-5, and Cabosil® EH-5, all available from Cabot Corporation. Prior to reaction with the coupling agents, the silica particles are treated to remove water by subjecting them to heating at 100° to 150° C. under vacuum for 24 hours and storing them in a dessicator.

Examples of suitable coupling agents include hydroxyalkyl silanes and aminoalkyl silanes. Preferably, the alkyl portion of the coupling agent has from about 2 to about 10 carbon atoms, and most preferably is a propyl group or a butyl group. Also suitable are hydroxyalkylaryl silanes, aminoalkylaryl silanes, hydroxyaryl silanes, and aminoaryl silanes. Hydroxyalkyl silanes, aminoalkyl silanes, hydroxyalkylaryl silanes, aminoalkylaryl silanes, hydroxyaryl silanes, and aminoaryl silanes, as defined herein, also include substituted compounds with from 1 to 3 alkoxy substituent groups attached to the silane portion of the molecule. Examples of suitable coupling agents are aminopropyltriethoxysilane, N,N-(2'-hydroxyethyl)-3-aminopropyltriethoxysilane, 4-aminobutyltriethoxysilane, (aminoethyl)-(aminomethyl)-phenethyltrimethoxysilane, N-(2-aminoethyl)-3-aminopropyltrimethoxysilane, N-(2-aminoethyl)-3-aminopropyltrimethoxysilane, p-aminophenyltriethoxysilane, N-(2-aminoethyl)-3-aminopropylmethyldimethoxysilane, 3-aminopropyltrimethoxysilane, 3-aminopropylmethyldimethoxysilane, and the like.

Suitable dyes include those that are water-soluble and react rapidly and in high yield with hydroxyl or amino groups. Generally, suitable dyes for the present invention are of the class known as reactive dyes and widely used in the textile industry. The dyes comprise a chromophore soluble in water, such as an anthraquinone, a monoazo dye, a disazo dye, a phthalocyanine, an aza[1-8]annulene, a formazan copper complex, a triphenodioxazine, and the like, to which is covalently attached a reactive group, such as a dichlorotriazine, a monochlorotriazine, a dichloroquinoxaline, an aminoepoxide, a mono-(m-carboxypyridinium)-triazine, a 2,4,5-trihalogenopyrimidine, a 2,4-dichloropyrimidine, a 2,3-dichloroquinoxaline, a monofluorotriazine, a 4,5-dichloro-6-methyl-2-methylsulfonylpyrimidine, a 1,4-dichlorophthalazine, a chlorobenzothiazole, a sulfatoethylsulfone, a β-chloroethylsulfone, a 4,5-dichloro-6-pyridazone, an α-bromoacryloylamido, an α,β-dibromopropionylamido, and the like. Examples of suitable dyes include Levafix Brilliant Yellow E-GA, Levafix Yellow E2RA, Levafix Black EB, Levafix Black E-2G, Levafix Black P-36A, Levafix Black PN-L, Levafix Brilliant Red E6BA, and Levafix Brilliant Blue EFFA, available from Bayer, Procion Turquoise PA, Procion Turquoise HA, Procion Turquoise H-5G, Procion Turquoise H-7G, Procion Red MX-5B, Procion Red MX 8B GNS, Procion Red G, Procion Yellow MX-8G, Procion Black H-EXL, Procion Black P-N, Procion Blue MX-R, Procion Blue MX-4GD, Procion Blue MX-G, and Procion Blue MX-2GN, available from ICI, Cibacron Red F-B, Cibacron Black BG, Lanasol Black B, Lanasol Red 5B, Lanasol Red B, and Lanasol Yellow 4G, available from Ciba-Geigy, Basilen Black P-BR, Basilen Yellow EG, Basilen Brilliant Yellow P-3GN, Basilen Yellow M-6GD, Basilen Brilliant Red P-3B, Basilen Scarlet E-2G, Basilen Red E-B, Basilen Red E-7B, Basilen Red M-5B, Basilen Blue E-R, Basilen Brilliant Blue P-3R, Basilen Black P-BR, Basilen Turquoise Blue P-GR, Basilen Turquoise M-2G, Basilen Turquoise E-G, and Basilen Green E-6B, available from BASF, Sumifix Turquoise Blue G, Sumifix Turquoise Blue H-GF, Sumifix Black B, Sumifix Black H-BG, Sumifix Yellow 2GC, Sumifix Supra Scarlet 2GF, and Sumifix Brilliant Red 5BF, available from Sumitomo Chemical Company, and the like.

Generally, the colorless silica particles are first reacted with the silane coupling agent in the absence of water, followed by reaction of the coupling agent with the dye. A solution is prepared containing a solvent such as dry toluene, benzene, xylene, hexane, or other similar aromatic or aliphatic solvents, containing the coupling agent in a relative amount of from about 0.1 to about 10 weight percent, and preferably from about 2 to about 5 weight percent. The dry silica particles are then suspended in the solution in a relative amount of from about 0.1 to about 10 weight percent, and preferably from about 1 to about 5 weight percent, and the suspension is subsequently heated at reflux temperature, which generally is about 111° C., for 2 to 24 hours, and preferably from 4 to 8 hours. During the process, water generated by the reaction is removed by a Dean-Stark trap. The process yields silica particles having silane coupling agents covalently attached thereto. These particles are separated from the suspension by high speed centrifugation (over 10,000 r.p.m.) or filtration after the suspension has cooled to room temperature, and the particles are washed, first with toluene and then methanol, and dried. Dyeing of the particles is effected by suspending the particles in water in a relative amount of from about 0.1 to about 20 weight percent, and preferably from about 5 to about 10 weight percent, and then adding the dye in a relative amount of from about 0.5 to about 10 weight percent, preferably from about 1 to about 4 weight percent, and stirring at room temperature for about 4 to 48 hours and preferentially for about 6 to about 24 hours to yield colored silica particles. The colored particles generally comprise from about 65 to about 98, and preferably from about 90 to about 95 percent by weight of the silica, from about 1 to about 20, and preferably from about 5 to about 10 percent by weight of the coupling agent, and from about 1 to about 30, and preferably from about 5 to about 15 percent by weight of the dye. In general, the formed particles are from about 10 to about 500 nanometers in average particle diameter, and preferably are from about 20 to about 300 nanometers in average particle diameter, as determined by Brookhaven BI-90 Particle Sizer.

Colored silica particles can also be prepared as disclosed in U.S. Pat. Nos. 4,566,908 and 4,576,888, the disclosures of each of which are totally incorporated herein by reference. Toners of the present invention containing colored silica particles prepared by the processes described above, however, exhibit significant advantages over toners containing colored silica particles prepared according to the methods set forth in U.S. Pat. Nos. 4,566,908 and 4,576,888. For example, the synthetic process set forth herein essentially entails two steps, and can be performed with commercially available silicas and dyes. In contrast, the processes set forth in U.S. Pat. Nos. 4,566,908 and 4,576,888 entail lengthy syntheses that entail a step-wise building of the chromophores on the surface of the silica and that require careful purification of all intermediates to ensure complete separation of contaminants, which may be toxic or have a deleterious effect on the color and stability characteristics of the particles eventually produced. In addition, the process for preparing silica particles set forth herein can result in production of silica particles having an average diameter of from about 10 to about 50 nanometers, whereas the silica particles prepared according to the processes of U.S. Pat. Nos. 4,566,908 and 4,576,888 typically have diameters ranging from 1 micron (1,000 nanometers) to 10 microns. The size of the silica particle can affect color strength, in that the smaller the diameter of the particle, the higher the optical density of the colored particle. This effect results from the difference in the number of sites per unit silica weight available for coupling with a dye. Accordingly, toners containing particles as prepared in U.S. Pat. Nos. 4,566,908 and 4,576,888 generally contain the silica particles in an amount of from about 3 to about 20 percent by weight, whereas toners containing silica particles prepared as described above generally contain the silica particles in an amount of from about 1 to about 5 percent by weight. Since the colorant is often the most expensive ingredient of a toner, lower colorant concentrations can result in lowered toner costs. In addition, the smaller the colorant particle diameter, the more transparent is the color of the toner. This effect results from a decrease in the intensity of light scattering as a function of particle size. The toners of the present invention containing colored particles prepared as described above are generally suitable for printing on transparencies for projected images, and also tend to provide superior color mixing in full color imaging.

The colored silica particles are mixed with a polymer containing at least one block or segment with an affinity for the silica particles and at least one block or segment with an affinity for the toner resin. The polymer can generally be any polymer having these characteristics and capable of adsorbing onto the surface of the silica particle. Generally, resins suitable for use in toners tend to be hydrophobic in nature. The colored silica particles, however, are generally hydrophilic and often are not compatible with hydrophobic resins such as those most suitable for toners, in which they tend to flocculate. Thus, at least one block or segment of the polymer is generally hydrophobic or apolar and at least one block or segment of the polymer is generally hydrophilic or polar. The hydrophilic portions of the polymers become adsorbed onto the surfaces of the hydrophilic silica particles, and the hydrophobic portions of the polymers enable the silica particles to disperse uniformly in the hydrophobic resin. The terms hydrophobic and hydrophilic as used herein are relative, in that the polymer contains at least two segments, wherein one segment is hydrophilic with respect to the other segment. For example, in a polymer containing segment A and segment B, segment A may function as the hydrophobic segment that enhances solubility of the silica particles in the resin when segment B is hydrophilic with respect to segment A. In another polymer containing this same segment A and segment C, however, segment A may function as the hydrophilic segment that adsorbs onto the silica particle surfaces when segment A is hydrophobic with respect to segment A. Suitable polymer configurations include diblock copolymers, with one polar hydrophilic segment and one apolar hydrophobic segment, triblock copolymers, either with one polar hydrophilic segment and two apolar hydrophobic segments or with two polar hydrophilic segments and one apolar hydrophobic segment, multiblock copolymers with at least one polar hydrophilic segment and at least one apolar hydrophobic segment, graft copolymers, either wherein the backbone is generally apolar and hydrophobic and the grafted portions are generally polar and hydrophilic, or wherein the backbone is generally polar and hydrophilic and the grafted portions are generally polar and hydrophobic, and the like. Particularly preferred for the present invention are diblock copolymers and triblock copolymers.

Examples of suitable monomers for the apolar hydrophobic block or segment of the polymer include vinyl monomers, such as styrene, styrene derivatives and cogeners such as alkyl styrenes wherein the alkyl group has from 1 to about 20 carbon atoms, halogenated styrenes such as p-chlorostyrene, vinyl naphthalene, and the like, vinyl halides such as vinyl chloride, vinyl bromide, vinyl fluoride, and the like, vinyl ethers, such as methyl vinyl ether, vinyl ethyl ether, and the like, vinyl ketones, such as vinyl methyl ketone and the like, N-vinyl indole and N-vinyl pyrrolidene, vinyl esters, such as vinyl acetate, vinyl propionate, vinyl benzoate, and vinyl butyrate, and the like; acrylic monomers and esters of monocarboxylic acids, such as acrylates and alkylacrylates with the alkyl group having at least one carbon atom, and generally from about 1 to about 12 carbon atoms, such as methacrylates, methylacrylates, ethacrylates, ethylacrylates, and the like, including methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate, and the like; olefins, including monoolefins and polyolefins, such as ethylene, propylene, butylene, butadiene, isobutylene, cycloolefins, such as cyclopentene. The apolar segment can also be derived by the condensation polymerization of difunctional monomers to yield polyesters, polyamides, polyurethanes, or the like, such as polyethyleneterephthalate, polyhexamethylene adipamide (nylon 6,6), or the like. Mixtures of two or more monomers can also be employed in the apolar hydrophobic block.

Examples of suitable monomers for the polar or hydrophilic block or segment of the polymer include cyclic ethers, including those of the formula

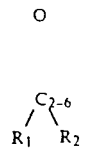

wherein the ring has from about 2 to about 6 carbon atoms and wherein $R_1$ and $R_2$ are selected from the group consisting of hydrogen, alkyl groups with from 1 to about 12 carbon atoms, and aryl groups with from 6 to about 12 carbon atoms. Specific examples of $R_1$ and $R_2$ include methyl, ethyl, propyl, butyl, phenyl, tolyl, naphthyl, and the like. Any one or more of the carbon atoms in the ring can be substituted with $R_1$ and/or $R_2$. Specific examples of cyclic ethers include ethylene oxide, propylene oxide, tetramethylene oxide, and the like.

Also suitable are cyclic esters of the formula

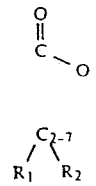

wherein the ring has from about 2 to about 7 carbon atoms in addition to the carbonyl carbon and wherein $R_1$ and $R_2$ are selected from the group consisting of hydrogen, alkyl groups with from 1 to about 12 carbon atoms, and aryl groups with from 6 to about 12 carbon atoms. Specific examples of $R_1$ and $R_2$ include methyl, ethyl, propyl, butyl, phenyl, tolyl, naphthyl, and the like. Any one or more of the carbon atoms in the ring can be substituted with $R_1$ and/or $R_2$.

Also suitable are cyclic amides of the formula

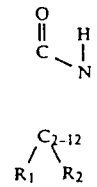

wherein the ring has from about 2 to about 12 carbon atoms in addition to the carbonyl carbon and wherein $R_1$ and $R_2$ are selected from the group consisting of hydrogen, alkyl groups with from 1 to about 12 carbon atoms, and aryl groups with from 6 to about 12 carbon atoms. Specific examples of $R_1$ and $R_2$ include methyl, ethyl, propyl, butyl, phenyl, tolyl, naphthyl, and the like. Any one or more of the carbon atoms in the ring can be substituted with $R_1$ and/or $R_2$.

Also suitable are vinyl carboxylic acids and their corresponding esters of the general formula

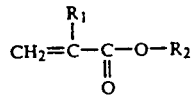

wherein $R_1$ and $R_2$ are independently selected from hydrogen and alkyl groups with from 1 to about 20 carbon atoms, including acrylic acid, methacrylic acid, paracarboxystyrene, and the like.

Also suitable are cyclic amines of the general formula

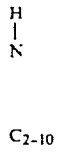

$C_{2-10}$ wherein the ring has from about 2 to about 10 carbon atoms, including ethylene imine and the like.

Also suitable are oxazolines of the general formula

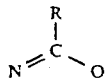

$C_{2-7}$ wherein R is hydrogen, an alkyl group with from 1 to about 6 carbon atoms, or benzyl and the ring has from about 2 to about 7 carbon atoms in addition to the carbon atom situated between the nitrogen and oxygen atoms, including ethyloxazoline, and the like.

Also suitable are acrylamides of the general formula

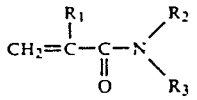

wherein $R_1$ is hydrogen, methyl, or ethyl, and $R_2$ and $R_3$ are independently selected from hydrogen and alkyl groups with from 1 to about 4 carbon atoms, and the like. Additional examples of suitable materials are aldehydes, such as formaldehyde, acetaldehyde, and the like; isocyanates that yield polyurethanes and polyureas when reacted with difunctional alcohols and amines, such as toluene diisocyanates, methylene bis diisocyanate, or the like, wherein the block copolymers of the present invention contain the polyurethane or polyurea segment as the polar segment; and similar materials. In addition, for the embodiment of the present invention wherein the polar or hydrophilic block or segment of the polymer is ionophoric or ion binding, this segment or block can comprise any of the ionophoric polymeric materials disclosed in U.S. Pat. No. 4,592,989, the disclosure of which is totally incorporated herein by reference. Some examples of suitable ionophoric polymeric segments include carbon chain polymers with pendent crown ether groups, polymers of 4'-vinyl benzo 10' crown-6, condensation polymers bearing an in-chain cyclic polyether, diaza polyether, or aza polyether group, open chain polyethers, polyethylene oxide, hydrolized polyethyloxazoline, and the like. Suitable ionophoric segments also include those prepared from monomers of carboxylic acids, such as acrylic acids, methacrylic acids, paracarboxystyrene, and the like, cyclic amine monomers, and oxazoline monomers. Another suitable ion binding or ionophoric segment is polytetrahydrofuran-2,5-diyl, having the general formula

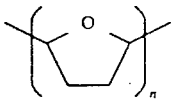

The block copolymer can comprise any suitable hydrophobic and hydrophilic monomers, provided that at least one hydrophobic block or segment and at least one hydrophilic block or segment is present. Some specific examples of suitable block copolymers include polystyrene/polyethylene oxide diblock copolymers, polybutadiene/polyethylene oxide diblock copolymers, polystyrene/poly(ethyloxazoline)diblock copolymers, polybutadiene/poly(ethyloxazoline)diblock copolymers, polystyrene/linear polyethylene imine diblock copolymers (such as those derived from the hydrolysis of polystyrene/polyalkyloxazoline diblock polymers), polystyrene/polytetrahydrofuran-2,5-diyl diblock copolymers, polybutadiene/polytetrahydrofuran-2,5-diyl diblock copolymers, polyethylene/polyethylene oxide diblock copolymers, diblock copolymers of carboxy or hydroxy terminated polyesters and polyethylene oxide, polyethylene oxide/polystyrene/polyethylene oxide triblock copolymers, polyethylene oxide/polybutadiene/polyethylene oxide triblock copolymers, polytetrahydrofuran-2,5-diyl/polystyrene/polytetrahydrofuran-2,5-diyl triblock copolymers, polystyrene/polytetrahydrofuran-2,5-diyl/polystyrene triblock copolymers, and the like. Suitable graft copolymers can also be employed, such as a polystyrene backbone having polyethylene oxide groups pendent from the phenyl groups on the backbone, preferably with from about 9 to about 22 repeating polyethylene oxide units, or a styrene polyether methacrylate copolymer wherein the methacrylate units are esterified with polyethylene oxide, as disclosed in U.S. Pat. No. 4,592,989. In each instance, the preferred block or graft copolymer will have an apolar or hydrophobic segment that is compatible with the toner resin selected. Compatibility is often likely when the apolar or hydrophobic segment is similar to or identical to the toner resin, although this is not required to ensure compatibility.

Also suitable as block copolymers for the toners of the present invention are surfactant materials such as those commercially available as "Pluronics" from Wyandotte Chemical Company. Typically, these materials are polyethylene oxide and polypropylene oxide diblock and triblock copolymers in which the molecular weight of the polypropylene oxide portion ranges from about 1,000 to about 3,000 and the polyethylene oxide portion is present in an amount of from about 3 to about 300 moles. Typical examples include Pluronics L44, wherein the polypropylene oxide segment has a molecular weight of from about 1,000 to about 2,000 and the copolymer contains about 20 moles of ethylene oxide; Pluronics L62, wherein the polypropylene oxide segment has a molecular weight of from about 1,500 to about 1,800 and the copolymer contains about 10 moles of ethylene oxide; and Pluronics L64, wherein the polypropylene oxide segment has a molecular weight of from about 1,500 to about 1,800 and the copolymer contains about 25 moles of ethylene oxide. Other suitable surfactants that can function as the block copolymer in the toners of the present invention include alkyl and alkylaryl ethylene oxides of the general formula

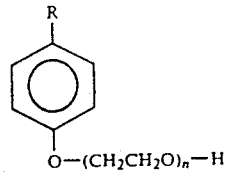

wherein R is an alkyl group with from 1 to about 20 carbon atoms and n is a number of from 1 to about 20, such as the Tergitol series available from GAF, the Igepal series available from Union Carbide, and the Triton series available from Rohm and Haas, as well as polyethylene glycol long chain alkyl esters such as those available as the CHP series from Witco Chemical Company or as the Emcol series from Hall Chemical Company. Other examples of suitable surfactants or dispersants of this type are listed in Rosen and Goldsmith, *Systematic Analysis of Surface Active Agents*, Wiley Interscience (1982), the disclosure of which is totally incorporated herein by reference. These materials are suitable as block copolymers for the toners of the present invention when the selected toner resin is sufficiently polar that the polypropylene oxide block of the copolymer is miscible therein, such as a low-melting polar polyester.

The polar or hydrophilic block or segment of the polymer need not be of great length; for the purposes of the present invention, the hydrophilic or polar block or segment should be sufficiently long to enable the polymers to become adsorbed onto the surfaces of the colored silica particles. For example, when the hydrophilic block or segment of the polymer is polyethylene oxide, of the formula shown $$HO-(CH_2-CH_2-)_n$$

a polyethylene oxide segment with a minimum of about 6 repeating units (n=6) can be sufficient in length to enable the polymer to adsorb onto the silica particle surface. In general, the polar or hydrophilic block or segment of the polymer has at least about 2 or 3 repeating units, and generally ranges in size up to a molecular weight of about 100,000, although the length of this portion can be outside of this range provided that the objectives of the present invention are achieved. Typical molecular weights of suitable polar blocks are from about 500 to about 20,000, and are preferably from about 2,000 to about 4,000, although the molecular weight of the polar block can be outside of this range provided that the objectives of the present invention are achieved. When the polar block is ionophoric and a salt is complexed with the polymer, the polar block generally has at least about 6 repeating units or a molecular weight of at least about 300.

The apolar or hydrophobic block or segment of the polymer generally is sufficiently long to enable the silica particles to which the polymers have become adsorbed to exhibit miscibility in the selected toner resin and to enhance the dispersion of the silica particles within the toner resin. As used herein with respect to the apolar or hydrophobic portion of the copolymers of the toners of the present invention, the term "miscible" means that the apolar or hydrophobic block of the copolymer is a species that is soluble in or miscible with the toner resin selected to the degree that the apolar or hydrophobic species, when dispersed in the toner resin, will not form a separate polymer phase of substantial dimension. By "substantial dimension" is meant that the apolar or hydrophobic species will not form domains within the toner polymer of greater than 100 nanometers in diameter. Thus, the apolar or hydrophobic species is one that is either soluble in the toner resin or dispersable in the toner resin at a domain size of 100 nanometers or less. In general, the polar or hydrophilic block or segment of the polymer has a molecular weight of from about 20,000 to about 150,000, and preferably from about 20,000 to about 40,000, although the molecular weight of the apolar block can be outside of this range provided that the objectives of the present invention are achieved.

The block or segment length for both the apolar hydrophobic block or segment and the polar hydrophilic block or segment also are generally determined so that they are in desirable relative proportions. For example, when the polar hydrophilic block or segment is relatively short, an extremely long apolar hydrophobic block or segment should generally be avoided to prevent the hydrophilic portion of the polymer from becoming "buried" within the hydrophobic portion. Generally, the maximum chain length of the polymer, especially the chain length of the apolar block of the polymer, is limited only by the desired molecular weight and viscoelasticity of the polymer.

The selected polymer can be prepared by any suitable process. Examples of processes that can be employed for preparing copolymers suitable for the present invention are disclosed in J. J. O'Malley et al., "Synthesis and Thermal Transition Properties of Styrene/Ethylene Oxide Block Copolymers," *Block Copolymers*, Plenum Press (1970); W. I. Schultz et al., *J. Am. Chem. Soc.*, 102, 7981 (1980); *J. Appl. Polym. Sci.*, 20, 773 (1976); *J. Appl. Polym. Sci.*, 20, 1665 (1976): *Macromolecules*, 12, 1638 (1979); *Makromol. Chem. Rapid Commun.*, 2, 161 (1981); *J. Polym. Sci., Polym. Chem.*, 17, 1573 (1979); W. Dittmann and K. Hamann, *Chemiker*, 96 (1972); *Nouveau Journal de Chemie*, 6 (12), 623 (1982); *Macromolecules*, 13, 1339 (1980); *Z. Anal. Chem.*, 313, 407 (1982); *J. Polym. Sci., Polymer Chem. Ed.*, 21, 855 (1983); *J. Polym. Sci., Polymer Chem. Ed.*, 21, 3101 (1983); *Makromol. Chem.*, 184, 535 (1983); *J. Polym. Sci., Pt. Al*, 9, 817 (1974); *Macromolecules*, 12, 1038 (1979); *Macromolecules*, 6, 133 (1973); *Pure Appl. Chem.*, 57, 111 (1979); and D. C. Allport and W. H. James, *Block Copolymers*, Chapters 1 through 7, Applied Science Publishers Ltd., London (1973), the disclosures of each of which are totally incorporated herein by reference. In addition, processes for preparing polymers such as polystyrene-block-polyisoprene, polystyrene-block-poly(2-methyl tetrahydrofuran 2,5 diyl), polystyrene-block-polyethylene oxide, polystyrene-methoxy polyethylene glycol 1,000 monoacrylate, and the like are disclosed in the Examples of U.S. Pat. No. 4,592,989, the disclosure of which has previously been incorporated herein by reference in its entirety.

The colored silica particles and the polymer are then mixed together by dispersing the colored silica particles in a suitable dispersing agent such as water, a cellosolve such as ethoxy cellosolve, an alcohol such as methanol or ethanol, or the like, dissolving the polymer in a suitable solvent in which the polymer is soluble and which is at least partially miscible with the dispersant for the silica particles, such as tetrahydrofuran, an alcohol, an ester such as ethyl acetate, acetonitrile, or the like, adding the silica particle dispersion to the polymer solution and mixing, and subsequently isolating from the solution the resulting silica particles having adsorbed thereon the polymers by any suitable isolation process, such as by adding to the solution a solvent in which the block copolymer is insoluble, evaporation of the solvents, freeze drying, or the like. While not being limited by theory, it is believed that the polar hydrophilic portion of the polymer becomes adsorbed to the surface of the silica particle as a result of the attraction between Lewis acid sites on the silica particle surface and Lewis base sites on the polar hydrophilic portion of the polymer. The ratio of silica particles to copolymer is generally selected according to the relative size of the polar portion of the copolymer, in that the minimum amount of copolymer admixed with the silica particles is sufficient to result in coverage of the surfaces of the silica particles with the polar portions of the copolymers. Typical examples of suitable particle to polymer ratios include, but are not limited to, one part by weight silica particles per one part by weight of the polar hydrophilic portion of the copolymer, 10 parts by weight silica particles per one part by weight of the polar hydrophilic portion of the copolymer, one part by weight silica particles per 2 parts by weight of the entire copolymer, and the like.

When the selected polymer contains an ionophoric block or segment, such as polyethylene oxide or those ionophoric polymers disclosed in U.S. Pat. No. 4,592,989, a salt can be incorporated into the polymer which functions as a charge control agent. Thus, the charge control agent can be incorporated into the polymer at the same time that the colored silica particles are dispersed in the polymer.

The polymer can be complexed with salts by any suitable method. For example, the polymer and salt can each be dissolved in a common solvent, followed by admixing of the solutions. In one specific example, complexation can be achieved by first dissolving about 1 gram of potassium thiocyanate (KSCN) in about 20 milliliters of methanol, followed by addition of this solution to 4 grams of dissolved polymer in about 20 milliliters of methanol. Subsequent to mixing and separation, a polymer complexed 100 percent with KSCN is obtained as determined by differential scanning calorimetry (DSC).

For the present invention, when a salt is to be complexed with an ionophoric portion of the polymer, the polymer is dissolved in a suitable solvent as described above, and to this solution is added a solution of the desired salt in a suitable solvent. Subsequent to mixing the polymer and the salt, the suspension of colored silica particles is added to the polymer as described above to form colored silica particles having adsorbed on their surfaces the polymers, wherein the polymers contain the salt complexed thereto.

Examples of cations that can be incorporated into ionophoric polymers include alkali metal salts, alkaline earth salts, transition metal salts, and other similar salts, provided that the objectives of the present invention are achieved. Specific examples of suitable cations include alkali metal cations such as lithium, sodium potassium, cesium, and rubidium; alkaline earth metal cations such as berylium, calcium, strontium, magnesium, and barium; rare earth metal cations such as germanium, gallium, lanthanum, erbium, praseodymium, and the like; and transition metal and other cations such as titanium, chromium, iron silver, gold, mercury, zinc, aluminum, tin, and the like. Also suitable as cations are ammonium cations such as ammoniums and alkyl ammonium salts of the formulas $NH_4+$, $NHR_3+$, $NH_2R_2+$, or $NH_3R+$, wherein the R groups are alkyl groups of from 1 to about 24 carbon atoms.

The cations are incorporated into the ion binding polymer as composite neutral salts. In the composite salt, the anion of the salt remains in close proximity to the cation. Typical anions include halides, such as fluoride, chloride, bromide, or iodide; electronegative anions, such as nitrate, perchlorate, thiocyanate, and the like; organic anions, such as citrate, acetate, picrate, tetraphenyl boride, paratoluene sulfonate, and the like; complex anions such as ferricyanide, ferrocyanide, hexachloroantimonate, hexafluorophosphate, tetrafluoborate, and the like.

The cation is complexed to the ionophoric portion of the block copolymer in an amount of from about 0.5 percent to about 100 percent of the possible complexation sites on the polymer, with the amount depending on the binding capacity of the polymer. Preferably, the cation is complexed to the ionophoric portion of the block copolymer in an amount of from about 5 to about 25 mole percent, or in an amount of from about 4 to about 20 moles of ionophoric monomers per mole of cation.

The material comprising colored silica particles and a diblock copolymer can then be mixed with a toner resin to form a dry electrophotographic toner. The resins contained in the toners of the present invention generally can be any resin suitable for electrophotographic toners, such as polyesters, polyamides, epoxies, polyurethanes, diolefins, polyolefins, vinyl resins, polymeric esterification products of a dicarboxylic acid and a diol comprising a diphenol, and the like. Typical vinyl monomers include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids, including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, including vinyl methyl ether, vinyl isobutyl ether, and vinyl ethyl ether; vinyl ketones such as vinyl methyl ketone, vinyl hexyl ketone, and methyl isopropenyl ketone; N-vinyl indole and N-vinyl pyrrolidene; polyolefins, such as styrene butadienes, especially those available as Pliolites; and mixtures of these monomers. The resins are present in the toners of the present invention in an effective amount, generally from about 30 to about 99 percent by weight of the toner composition, although they may be present in greater or lesser amounts, provided that the objectives of the invention are achieved.

If desired, the toners of the present invention can contain charge control additives. When the polymer contains an ionophoric segment and a salt is incorporated into the polymer, the toner need not contain additional charge control agents, but can contain these materials if so desired. Typical charge control agents include cetyl pyridinium chloride, distearyl dimethyl ammonium methyl sulfate, potassium tetraphenyl borate, and the like. Additional examples of suitable charge control additives are disclosed in U.S. Pat. Nos.

4,560,635 and 4,294,904, the disclosures of each of which are totally incorporated herein by reference. When present, the charge control agent is present in an effective amount, generally from about 0.1 to about 4 percent by weight, and preferably from about 0.5 to about 1 percent by weight, although the amount can be outside of these ranges.

External additives may also be present in the above described toners in instances such as when toner flow is to be assisted, or when lubrication is desired to assist a function such as cleaning of the photoreceptor. The amounts of external additives are measured in terms of percentage by weight of the toner composition. For example, a toner composition containing a resin, a pigment, and an external additive may comprise 80 percent by weight of resin and 20 percent by weight of pigment, and may also comprise 0.2 percent by weight of an external additive. External additives may include any additives suitable for use in electrostatographic toners, including fumed silica, silicon derivatives such as Aerosil R972®, available from Degussa, Inc., ferric oxide, hydroxy terminated polyethylenes such as Unilin, polyolefin waxes, polymethylmethacrylate, zinc stearate, chromium oxide, aluminum oxide, titanium oxide, stearic acid, polyvinylidene fluorides such as Kynar®, and other known or suitable additives. External additives may be present in various effective amounts, provided that the objectives of the present invention are achieved. Preferably, external additives are present in an amount of from about 0.1 to about 4 percent by weight, and more preferably from about 0.5 to about 1 percent by weight.

The toner compositions may be prepared by any suitable method. For example, a method known as spray drying entails dissolving the appropriate polymer or resin in an organic solvent such as toluene or chloroform, or a suitable solvent mixture. The toner colorant is also added to the solvent. Vigorous agitation, such as that obtained by ball milling processes, assists in assuring good dispersion of the colorant. The solution is then pumped through an atomizing nozzle while using an inert gas, such as nitrogen, as the atomizing agent. The solvent evaporates during atomization, resulting in toner particles of a pigmented resin, which are then attrited and classified by particle size. Particle diameter of the resulting toner varies, depending on the size of the nozzle, and generally varies between about 0.1 and about 100 microns.

Another suitable process is known as the Banbury method, a batch process wherein the dry toner ingredients are pre-blended and added to a Banbury mixer and mixed, at which point melting of the materials occurs from the heat energy generated by the mixing process. The mixture is then dropped into heated rollers and forced through a nip, which results in further shear mixing to form a large thin sheet of the toner material. This material is then reduced to pellet form and further reduced in size by grinding or jetting, after which the particles are classified by size. A third suitable toner preparation process, extrusion, is a continuous process that entails dry blending the toner ingredients, placing them into an extruder, melting and mixing the mixture, extruding the material, and reducing the extruded material to pellet form. The pellets are further reduced in size by grinding or jetting, and are then classified by particle size. Other similar blending methods may also be used. Subsequent to size classification of the toner particles, any external additives are blended with the toner particles.

Toners of the present invention can be employed as single component developers, or as two component developers by mixing the toner particles with carrier particles. Carrier particles selected for the process of the invention may be chosen from a number of known materials, provided that the objectives of the invention are achieved. Illustrative examples of suitable carrier particles include granular zircon, steel, nickel, iron, ferrites, and the like. Other suitable carrier particles include nickel berry carriers as disclosed in U.S. Pat. No. 3,847,604, the disclosure of which is totally incorporated herein by reference. These carriers comprise nodular carrier beads of nickel characterized by surfaces of reoccurring recesses and protrusions that provide the particles with a relatively large external area. The diameters of the carrier particles may vary, but are generally from about 50 microns to about 1,000 microns, thus allowing the particles to possess sufficient density and inertia to avoid adherence to the electrostatic images during the development process.

The carrier particles may possess coated surfaces. Coating materials include polymers and terpolymers, including fluoropolymers as disclosed in U.S. Pat. Nos. 3,526,533; 3,849,186; and 3,942,979, the disclosures of which are totally incorporated herein by reference. Specific examples of carrier coatings include polyvinylidene, fluoride, polymethylmethacrylate, and mixtures thereof. Preferably, carrier coatings are present in an amount of from about 0.1 to about 1 percent by weight of the uncoated carrier particle, although other amounts are suitable provided that the objectives of the present invention are achieved.

Coating of the carrier particles may be by any suitable process, such as powder coating, wherein a dry powder of the coating material is applied to the surface of the carrier particle and fused to the core by means of heat, solution coating, wherein the coating material is dissolved in a solvent and the resulting solution is applied to the carrier surface by tumbling, or fluid bed coating, in which the carrier particles are blown into the air by means of an air stream, and an atomized solution comprising the coating material and a solvent is sprayed onto the airborne carrier particles repeatedly until the desired coating weight is achieved.

The toner composition is mixed with carrier particles so that the toner is present in an effective relative amount, generally from about 1 to about 5 percent by weight of the carrier, although different toner to carrier ratios can be selected.

When the toners of the present invention contain polymers with ionophoric segments having a salt complexed thereto, the toners exhibit excellent admix times, generally of 60 seconds or less. Typically, in a copier or printer employing a two-component developer, the supply of toner becomes depleted and fresh toner particles are added to the mixture of toner and carrier particles in the machine to replenish the developer. Admix time refers to the period required for the newly added toner particles to become triboelectrically charged to the same polarity and magnitude as toner particles that were present in the developer prior to addition of the fresh toner particles. Further details regarding admix time in general are disclosed in, for example, U.S. Pat. No. 4,426,436, the disclosure of which is totally incorporated herein by reference.

Specific embodiments of the invention will now be described in detail. These examples are intended to be illustrative, and the invention is not limited to the materials, conditions, or process parameters set forth in these embodiments. All parts and percentages are by weight unless otherwise indicated.

ATTACHMENT OF COUPLERS TO SILICA PARTICLES

Example I

To 9.6 grams of Aerosil ® 200, which had been dried at 100° C. for 24 hours in a 500 milliliter round bottom flask equipped with a magnetic stirrer and a Dean-Stark trap, were added 300 milliliters of toluene, which had previously been dried by azeotropic distillation under nitrogen, and 2.96 grams of aminopropyltriethoxysilane. The resulting suspension was refluxed at 111° C. for 5 hours, cooled to room temperature, and centrifuged at about 10,000 r.p.m., after which the supernatant liquid was poured off and the precipitate washed with 500 milliliters of dichloromethane. Subsequently, the mixture of precipitate and dichloromethane was centrifuged, the supernatant was removed, and the residue was dried in a vacuum oven at about 200 mm Hg at 40° C. for 2.5 days to yield 9.6 grams (76% yield) of a white powdery material comprising Aerosil ® 200 particles having covalently attached thereto aminopropyltriethoxysilane groups, as determined by the techniques described by M. W. Urban and J. L. Koenig in "Determination of the Orientation of Silanes on Silica Surfaces by Fourier Transform Infrared Photoacoustic Spectroscopy," *Applied Spectroscopy*, Vol. 40, no. 4, pages 513 to 519 (1986) and T. G. Waddell, D. E. Layden, and M. T. DeBello in "The Nature of Orgaonsilane to Silica Surface Bonding," *Journal of the American Chemical Society*, Vol. 103, pages 5303 to 5307 (1981), the disclosures of each of which are totally incorporated herein by reference.

Example II

To 49.38 grams of Aerosil ® 380, which had been dried at 110° C. for 22 hours in a 1,000 milliliter round bottom flask equipped with a mechanical stirrer and a Dean-Stark trap, were added 900 milliliters of toluene, which had previously been dried by azeotropic distillation under nitrogen, and 61.5 milliliters of aminopropyltriethoxysilane. The reaction mixture was refluxed at 111° C. for 5 hours, cooled to room temperature, and centrifuged at about 3,000 r.p.m., after which the supernatant liquid was poured off and the precipitate washed with 500 milliliters of methanol. Subsequently, the mixture of precipitate and methanol was centrifuged twice, the supernatant was removed, and the residue was again washed with 500 milliliters of water and centrifuged twice. The residue was redispersed in water and freeze-dried to yield 29.4 grams (37.5% yield) of a white powdery material comprising Aerosil ® 380 particles having covalently attached thereto aminopropyltriethoxysilane groups, as determined by the techniques described by M. W. Urban and J. L. Koenig in "Determination of the Orientation of Silanes on Silica Surfaces by Fourier Transform Infrared Photoacoustic Spectroscopy," *Applied Spectroscopy*, Vol. 40, no. 4, pages 513 to 519 (1986) and T. G. Waddell, D. E. Layden, and M. T. DeBello in "The Nature of Organosilane to Silica Surface Bonding," *Journal of the American Chemical Society*, Vol. 103, pages 5303 to 5307 (1981).

Example III

To 38.61 grams of Aerosil ® 380, which had been dried at 100° C. for 24 hours in a 2,000 milliliter round bottom flask equipped with a magnetic stirrer, a reflux condenser, and a thermometer, were added 800 milliliters of toluene, which had previously been dried by azeotropic distillation under nitrogen, and 96.1 milliliters of aminopropyltriethoxysilane. The reaction mixture was refluxed at 111° C. for 6 hours, cooled to room temperature, and filtered through a Whatman GFF/A filter paper. Subsequently, the solid was stirred in methanol for about 17 hours and refiltered, and the resulting solid was redispersed in methanol with a polytron and filtered a third time. The resulting solid was dried in a vacuum oven for 22 hours to yield 44.5 grams (75% yield) of a white powdery material comprising Aerosil ® 380 particles having covalently attached thereto aminopropyltriethoxysilane groups, as determined by the techniques described by M. W. Urban and J. L. Koenig in "Determination of the Orientation of Silanes on Silica Surfaces by Fourier Transform Infrared Photoacoustic Spectroscopy," *Applied Spectroscopy*, Vol. 40, no. 4, pages 513 to 519 (1986) and T. G. Waddell, D. E. Layden, and M. T. DeBello in "The Nature of Organosilane to Silica Surface Bonding," *Journal of the American Chemical Society*, Vol. 103, pages 5303 to 5307 (1981).

Example IV

To 10 grams of Aerosil ® 380, which had been dried at 150° C. for 20 hours in a 500 milliliter round bottom flask equipped with a magnetic stirrer and a reflux condenser, were added 273 milliliters of ethanol and 26.5 milliliters of an ethanol solution containing 62 percent by weight of N,N-bis-(2-hydroxyethyl)aminopropyltriethoxysilane. The reaction mixture was refluxed at 111° C. for 20 hours, cooled to room temperature, and centrifuged at about 8,000 r.p.m., after which the supernatant liquid was poured off and the precipitate washed with 500 milliliters of ethanol and centrifuged. Subsequently, the residue was washed and centrifuged twice with water, and the residue was redispersed in water and freeze-dried to yield 6.6 grams (36.2% yield) of a white powdery material comprising Aerosil ® 380 particles having covalently attached thereto N,N-bis-(2-hydroxyethyl)aminopropyltriethoxysilane groups, as determined by the techniques described by M. W. Urban and J. L. Koenig in "Determination of the Orientation of Silanes on Silica Surfaces by Fourier Transform Infrared Photoacoustic Spectroscopy," *Applied Spectroscopy*, Vol. 40, no. 4, pages 513 to 519 (1986) and T. G. Waddell, D. E. Layden, and M. T. DeBello in "The Nature of Organosilane to Silica Surface Bonding," *Journal of the American Chemical Society*, Vol. 103, pages 5303 to 5307 (1981).

Example V

To 19.86 grams of Aerosil ® 380, which had been dried at 100° C. for 24 hours in a 2,000 milliliter round bottom flask equipped with a mechanical stirrer, a thermometer, a reflux condenser, and a Dean-Stark trap, were added 500 milliliters of toluene, which had previously been dried by azeotropic distillation under nitrogen, and 52.5 milliliters of an ethanol solution containing 62 percent by weight of N,N-bis-(2-hydroxyethyl-)aminopropyltriethoxysilane. The reaction mixture was heated and the distillate in the Dean-Stark trap was discarded until the reaction mixture reached 111° C., after which the reaction mixture was refluxed at 111° C. for 6 hours and filtered with Whatman filter paper. The resulting precipitate was slurried in 500 milliliters of methanol, filtered with Whatman filters, and dried in vacuo at 120° C. for 24 hours to yield 21.87 grams of a white powdery material comprising Aerosil ® 380 particles having covalently attached thereto N,N-bis-(2-hydroxyethyl)aminopropyltriethoxysilane groups, as determined by the techniques described by M. W. Urban and J. L. Koenig in "Determination of the Orientation of Silanes on Silica Surfaces by Fourier Transform Infrared Photoacoustic Spectroscopy," *Applied Spectroscopy*, Vol. 40, no. 4, pages 513 to 519 (1986) and T. G. Waddell, D. E. Layden, and M. T. DeBello in "The Nature of Organosilane to Silica Surface Bonding," *Journal of the American Chemical Society*, Vol. 103, pages 5303 to 5307 (1981).

Example VI

To a mixture of 730 milliliters of absolute ethanol and 36 milliliters of concentrated aqueous ammonium hydroxide in a 1,000 milliliter round bottom flask equipped with a magnetic stirrer and a thermometer was added 30 milliliters of tetraethoxysilane. The reaction vessel was capped immediately, and the reaction mixture was then stirred at room temperature for 24 hours. Thereafter insoluble white silica particles formed which were separated by centrifugation at 15° C., 10,000 rpm for 10 minutes. Subsequently the particles were resuspended in 500 milliliters of deionized water. The pH of this suspension was adjusted to 7.5 by addition of a few drops of concentrated hydrochloric acid. The particles were then washed repeatedly with deionized water by ultrafiltration with a Minitan Acrylic System from Millipore Inc. Subsequently, the suspension of purified silica particles was concentrated to approximately 300 milliliters and the particles were isolated from this suspension by freeze-drying for 48 hours. There resulted a fine white powder, 7.8 grams, 96 percent yield, the particles of which had an average diameter of 45 nanometers as determined by transmission electron microscopy. To 5 grams of the isolated silica particles, which had been dried at 100° C. for 24 hours in a 2,000 milliliter round bottom flask equipped with a mechanical stirrer, a Dean Stark condenser, and a thermometer, were added 100 milliliters of toluene, which had previously been dried by azeotropic distillation under nitrogen, and 0.65 milliliter of aminopropyltriethoxysilane. The reaction mixture was refluxed at 111° C. for 6 hours, cooled to room temperature, and filtered through a Whatman GFF/A filter paper. Subsequently, the solid was stirred in methanol for about 17 hours and refiltered, and the resulting solid was redispersed in methanol and filtered a third time. The resulting solid was dried in a vacuum oven for 22 hours to yield 4.8 grams (75% yield) of a white powdery material comprising silica particles having covalently attached thereto aminopropyltriethoxysilane groups, as determined by the techniques described by M. W. Urban and J. L. Koenig in "Determination of the Orientation of Silanes on Silica Surfaces by Fourier Transform Infrared Photoacoustic Spectroscopy," *Applied Spectroscopy*, Vol. 40, no. 4, pages 513 to 519 (1986) and T. G. Waddell, D. E. Layden, and M. T. DeBello in "The Nature of Organosilane to Silica Surface Bonding," *Journal of the American Chemical Society*, Vol. 103, pages 5303 to 5307 (1981), the disclosure of which is totally incorporated herein by reference.

COLORATION OF SILICA PARTICLES

Example VII

A mixture of 1.0 gram of silica particles with attached couplers prepared according to the method of Example I and 1.0 gram of Levafix Brilliant Blue EFFA (available from Bayer) in 40 milliliters of water was stirred at room temperature for 18 hours in a round bottom flask equipped with a magnetic stirrer and was subsequently centrifuged. The residue was dispersed in water and centrifuged in water until the supernatant was colorless, after which the residue was redispersed in water and freeze-dried with a Dura-Dry TM freeze drier, available from FTS ® Systems, Stone Ridge, N.Y., to yield 0.75 gram of blue silica particles.

Example VIII

A mixture of 1.0 gram of silica particles with attached couplers prepared according to the method of Example I and 1.0 gram of Levafix Brilliant Red E6BA (available from Bayer) in 35 milliliters of water was stirred at room temperature for 18 hours in a round bottom flask equipped with a magnetic stirrer and was subsequently centrifuged. The residue was dispersed in water and centrifuged in water until the supernatant was colorless, after which the residue was redispersed in water and freeze-dried with a Dura-Dry TM freeze drier, available from FTS ® Systems, Stone Ridge, N.Y., to yield 0.60 grma of red silica particles.

Example IX

A mixture of 3.0 grams of silica particles with attached couplers prepared according to the method of Example II and 3.0 grams of Levafix Brilliant Red E6BA (available from Bayer) in 120 milliliters of water was stirred at room temperature for 22 hours in a round bottom flask equipped with a magnetic stirrer. Thereafter, the suspension was purified by ultrafiltration with a Minitan Acrylic System from Millipore Inc. until the supernatant was colorless. The suspension was concentrated to 20 milliliters and freeze-dried with a Dura-Dry TM freeze drier, available from FTS ® Systems, Stone Ridge, N.Y., to yield 2.3 grams of red silica particles.

Example X

A mixture of 1.0 gram of silica particles with attached couplers prepared according to the method of Example II and 2.0 grams of Procion Turquoise HA (available from ICI) in 50 milliliters of water was stirred at reflux temperature for 3.5 hours in a round bottom flask equipped with a magnetic stirrer and a condenser and was subsequently cooled to room temperature. Thereafter, the suspension was purified by ultrafiltration with a Minitan Acrylic System from Millipore Inc. until the supernatant was colorless. The suspension was concentrated to 20 milliliters and freeze-dried with a Dura-Dry TM freeze drier, available from FTS ® Systems, Stone Ridge, N.Y., to yield 1.0 gram of cyan silica particles.

Example XI

A mixture of 3.0 grams of silica particles with attached couplers prepared according to the method of Example II and 3.0 grams of Levafix Brilliant Blue EFFA (available from Bayer) in 120 milliliters of water was stirred at room temperature for 22 hours in a round bottom flask equipped with a magnetic stirrer. Thereafter, the suspension was purified by ultrafiltration with a Minitan Acrylic System from Millipore Inc. until the supernatant was colorless. The suspension was concentrated to 20 milliliters and freeze-dried with a Dura-Dry TM freeze drier, available from FTS® Systems, Stone Ridge, N.Y., to yield 2.4 grams of of blue silica particles.

Example XII

A mixture of 3.0 grams of silica particles with attached couplers prepared according to the method of Example III and 13.0 grams of Levafix Brilliant Blue EFFA (available from Bayer) in 300 milliliters of water was stirred at room temperature for 22 hours in a round bottom flask equipped with a magnetic stirrer. Thereafter, the suspension was purified by ultrafiltration with a Minitan Acrylic System from Millipore Inc. until the supernatant was colorless. The suspension was concentrated to 20 milliliters. The residue was dispersed in water and centrifuged in water until the supernatant was colorless, after which the residue was redispersed in water and freeze-dried with a Dura-Dry TM freeze drier, available from FTS® Systems, Stone Ridge, N.Y., to yield 2.2 grams of blue silica particles.

Example XIII

To a mixture of 31.0 grams of silica particles with attached couplers prepared according to the method of Example III and dried at 100° C. for 17 hours and Levafix Brilliant Blue EFFA (available from Bayer, Inc.) was added one liter of water. The resulting mixture was ball milled at room temperature for 3 days and then filtered with Whatman filter paper. The resulting precipitate was washed with 1 liter of water and filtered with Whatman filter paper, after which the resulting solid was dispersed in water. This dispersion was dialyzed against water using a Spectrapor 4 membrane, available from Canlab, for about 3 days, at which time the water remained colorless. The suspension was then freeze-dried with a Dura-Dry TM freeze drier, available from FTS® Systems, Stone Ridge, N.Y., to yield 10 grams of blue silica particles.

Example XIV

To a mixture of 5.0 grams of silica particles with attached couplers prepared according to the method of Example II and dried at 100° C. for 17 hours and 5.0 grams of Procion Yellow MX-8G (available from ICI) was added 200 milliliters of water. The suspension was stirred at 90° C. for 24 hours and then cooled to room temperature. Thereafter, the suspension was purified by ultrafiltration with a Minitan Acrylic System from Millipore Inc. until the supernatant was colorless. Subsequently, the suspension was concentrated to 20 milliliters and freeze-dried with a Dura-Dry TM freeze drier, available from FTS® Systems, Stone Ridge, N.Y., to yield 4.3 grams of yellow silica particles.

Example XV

To a mixture of 2.0 grams of silica particles with attached couplers prepared according to the method of Example II and dried at 100° C. for 17 hours and 2.0 grams of Levafix Black EB (available from Bayer) was added 60 milliliters of water. The suspension was stirred at room temperature for 24 hours and was thereafter purified by ultrafiltration with a Minitan Acrylic System from Millipore Inc. until the supernatant was colorless. The suspension was then concentrated to 20 milliliters and freeze-dried with a Dura-Dry TM freeze drier, available from FTS® Systems, Stone Ridge, N.Y., to yield 1.9 grams of black silica particles.

Example XVI

To a mixture of 3.0 grams of silica particles with attached couplers prepared according to the method of Example VI and dried at 100° C. for 17 hours and Procion Turquoise HA (available from ICI) was added 100 milliliters of water. The suspension was stirred at room temperature for 24 hours and was thereafter purified by ultrafiltration with a Minitan Acrylic System from Millipore Inc. until the supernatant was colorless. The suspension was then concentrated to 20 milliliters and freeze-dried with a Dura-Dry TM freeze drier, available from FTS® Systems, Stone Ridge, N.Y., to yield 2.8 grams of cyan silica particles.

PREPARATION OF COLORED TONERS

Example XVII

A positive charging toner containing cyan colored silica particles and a diblock copolymer/salt complex as dispersant and charge control agent was prepared as follows. A polystyrene/polyethylene oxide diblock copolymer (PS-b-POE) containing 60 mole percent of polystyrene and 40 mole percent of polyethylene oxide was prepared by a process analogous to that set forth in Example V of U.S. Pat. No. 4,592,989. Specifically, the copolymer was prepared by the aforementioned process with the exception that the synthesis was performed on a larger scale and was carried out under an inert atmosphere instead of under vacuum. To 60 milliliters of tetrahydrofuran was added 6.0 grams of the polystyrene/polyethylene oxide diblock copolymer. A thick solution of the copolymer in tetrahydrofuran was obtained upon dissolution with stirring and gentle heating at about 40° C. To this solution was added a solution of 0.5 gram of potassium thiocyanate (KSCN) in 10 milliliters of methanol, resulting in formation of a thick gel (PS-b-POE.KSCN). A suspension of cyan colored silica particles was prepared by adding 3 grams of "wet cake" cyan colored silica particles to 50 milliliters of a water/methanol (1:4 V/V) mixture. The cyan colored silica particles were prepared as described in Example X except that the suspension was concentrated to a "wet cake" and not freeze-dried. The wet cake suspension in water/methanol was then slowly added to the gel of PS-b-POE.KSCN to yield a deeply cyan-colored viscous suspension. The rate of addition of pigment suspension to the polymer/salt gel was slow enough so that the system was not "shocked" to the extent that would cause precipitation of the diblock polymer; specifically, the pigment suspension was added over a period of about 3 minutes by adding small amounts of the pigment suspension to the polymer/salt gel and stirring to dissolve the polymer before adding additional pigment. The resulting cyan-colored suspension was gently stirred for about 30 minutes, resulting in a uniformly colored suspension with no visible particulate material. After an additional 30 minutes of stirring the composite of cyan-colored silica particles dispersed in PS-b-POE.KSCN was isolated as follows: Hexane, 500 milliliters, was slowly added to the stirred suspension. The stirring was stopped and a thick blue viscous layer of polymeric material separated from the mixture. The supernatant was removed and the polymeric material was washed three times with 400 milliliter portions of a hexane/tetrahydrofuran mixture containing 9 parts by volume of hexane and 1 part by volume of tetrahydrofuran. This initial extraction process extracted water from the polymer layer and induced solidification. The resulting solid was then washed twice with 500 milliliter portions of hexane. The resulting product after air drying for about 16 hours and drying in vacuo at 40° C. for 48 hours was 7.85 grams of cyan-colored silica particles dispersed in PS-b-POE.KSCN.

A toner composition comprising copoly(styrene/-butadiene) (89/11 by weight) in an amount of 85 percent by weight, cyan-colored silica particles in an amount of 5 percent by weight, and PS-b-POE.KSCN in an amount of 10 percent by weight was prepared by melt blending four grams of cyan-colored silica particles dispersed in PS-b-POE.KSCN, prepared above, with 25 grams of copoly(styrene/butadiene) (89 percent by weight of styrene, 11 percent by weight of butadiene) commercially available from Goodyear Tire and Rubber Company as Pliotone. The materials were melt mixed at 140° C. in a CSI-Max extruder. The mixture was passed through the extruder three times. The resulting composition was then jetted into toner sized particles with a Trost air impact pulverizer to form toner particles with an average particle diameter of 10 microns.

Example XVIII

Toners prepared as in Example XVII tend to become positively charged. Toner prepared according to Example XVII is blended with a carrier consisting of a ferrite core coated with Pliotone (the resin used in the toner) and agitated as in a developer housing. The toner to carrier weight ratio is about 2:98. The toner thus agitated becomes positively charged with a tribo of from about 0.5 to about 0.8 femtocoulombs per milligram.

Additional toner prepared according to Example XVII is blended with a carrier comprising a ferrite core coated with a copolymer derived from fluorovinyl and chlorovinyl monomers (FPC 401, available from Firestone Plastics) and agitated as in a developer housing. The toner to carrier weight ratio is about 2:98. The toner thus agitated becomes positively charged with a tribo of from about 0.8 to about 1.3 femtocoulombs per milligram. This toner also exhibits good "admix" characteristics, in that when fresh uncharged toner is added to a blend of toner and carrier prepared in accordance with the above specifications the uncharged toner will, in 60 seconds or less, acquire the same charge as that of toner particles in the developer since time zero.

The charging characteristics of the toner of Example XVII can also be modulated by the incorporating of surface additives such as silica particles (in an amount of, for example, about 1 percent by weight of the toner particles) such as Aerosil R972 (available from Degussa), zinc stearate (in an amount of, for example, about 0.5 percent by weight of the toner particles), or fine particles of polymethylmethacrylate (in an amount of, for example, about 2 percent by weight of the toner particles). Silica and zinc stearate tend to induce negative charging characteristics and fine polymethylmethacryalte particles tend to induce positive charging characteristics.

The procedure of Example XVII can be used to prepare additional toners with colored silica particles and a diblock/salt complex dispersant and charge control agent, wherein any of the colored silica particles prepared in Examples VII through XVI are substituted for the material from Example X. This general procedure can also be employed with other diblock copolymers or graft copolymer/salt composites substituted for PS-b-POE/KSCN. The charging characteristics can be modulated by changing the nature of the salt complexed to the block copolymer as disclosed in U.S. Pat. No. 4,592,989.

Example XIX

For comparative purposes, a control toner composition is prepared by blending 1.2 grams of "wet cake cyan-colored silica particles" with 25 grams of copoly(-styrene/butadiene) (89/11 by weight) commercially available from Goodyear Tire and Rubber Company as Pliotone. The materials are melt mixed at 140° C. in a CSI-Max extruder. The mixture is passed throughout the extruder three times. The cyan colored silica particles are prepared as described in Example X except that the suspension is concentrated to a wet cake and not freeze-dried. The resulting composition is then jetted into toner sized particles with a Trost air impact pulverizer to form toner particles with an average particle diameter of 10 microns.

Example XX

The toner of Example XIX is blended with a carrier comprising a ferrite core coated with a copolymer derived from fluorovinyl and chlorovinyl monomers (FPC 401, available from Firestone Plastics) and agitated as in a developer housing. The toner to carrier weight ratio is about 2:98. The toner thus agitated becomes positively charged with a tribo of from about 0.6 to about 0.8 femtocoulombs per milligram. With respect to the "admix" characteristics of this toner, when fresh uncharged toner is added to a blend of toner and carrier prepared in accordance with the above specifications the uncharged toner will typically require over 10 minutes to acquire the same charge as that of the toner particles in the developer since time zero.

Example XXI

A positive charging toner containing cyan colored silica particles and a diblock copolymer as a dispersant was prepared as follows. A polystyrene/polyethylene oxide diblock copolymer (PS-b-POE) containing 60 mole percent of polystyrene and 40 mole percent of polyethylene oxide was prepared by a process analogous to that set forth in Example V of U.S. Pat. No. 4,592,989. Specifically, the copolymer was prepared by the aforementioned process with the exception that the synthesis was performed on a larger scale and was carried out under an inert atmosphere instead of under vacuum. To 60 milliliters of tetrahydrofuran was added 6.0 grams of the polystyrene/polyethylene oxide diblock copolymer. A thick solution of the copolymer in tetrahydrofuran was obtained upon dissolution with stirring and gentle heating at about 40° C. A suspension of cyan colored silica particles is made by adding 3 grams of wet cake cyan colored silica particles to 50 milliliters of a water/methanol (1:4 V/V) mixture. The cyan colored silica particles were prepared as described in Example X except that the suspension was concentrated to a "wet cake" and not freeze-dried. The wet cake suspension in water/methanol was then slowly added to the thick solution of PS-b-POE to yield a deeply cyan-colored suspension. The rate of addition of pigment suspension to the polymer solution was slow enough so that the system was not "shocked" to the extent that would cause precipitation of the diblock polymer; specifically, the pigment suspension was added over a period of about 3 minutes by adding small amounts of the pigment suspension to a stirred polymer solution, allowing the pigment to disperse before adding additional pigment. The resulting cyan-colored suspension was gently stirred for about 30 minutes, resulting in a uniformly colored suspension with no visible particulate material. After an additional 30 minutes of stirring the composite of cyan-colored silica particles dispersed in PS-b-POE was isolated as follows: Hexane, 500 milliliters, was slowly added to the stirred suspension. The stirring was stopped and a thick blue viscous layer of polymeric material separated from the mixture. The supernant was removed and the polymeric material was washed three times with 400 milliliter portions of a hexane/tetrahydrofuran mixture containing 9 parts by volume of hexane and 1 part by volume of tetrahydrofuran. This initial extraction process extracted water from the polymer layer and induced solidification. The resulting solid was washed twice with 500 milliliter portions of hexane and dried for about 16 hours and dried in vacuo at 40° C. for 48 hours to yield 7.45 grams of dry product, cyan-colored silica particles dispersed in PS-b-POE. A toner composition comprising copoly(-styrene/butadiene) (89/11) in an amount of 85 percent by weight, cyan-colored silica particles in an amount of 5 percent by weight, and PS-b-POE in an amount of 10 percent by weight was prepared by melt blending four grams of cyan-colored silica particles dispersed in PS-b-POE, prepared above, with 25 grams of copoly(-styrene/butadiene) (89 percent by weight of styrene, 11 percent by weight of butadiene) commercially available from Goodyear Tire and Rubber Company as Pliotone. The materials were melt mixed at 140° C. in a CSI-Max extruder. The mixture was passed through the extruder three times. The resulting composition was then jetted into toner sized particles with a Trost air impact pulverizer to form toner particles with an average particle diameter of 10 microns.

Example XXII

Toners prepared as in Example XXI tend to become positively charged. Toner prepared according to Example XXI is blended with a carrier consisting of a ferrite core coated with Pliotone (the resin used in the toner) and agitated as in a developer housing. The toner to carrier weight ratio is about 2:98. The toner thus agitated becomes positively charged with a tribo of from about 0.3 to about 0.5 femtocoulombs per milligram.

Additional toner prepared according to Example XXI is blended with a carrier comprising a ferrite core coated with a copolymer derived from fluorovinyl and chlorovinyl monomers (FPC 401, available from Firestone Plastics) and agitated as in a developer housing. The toner to carrier weight ratio is about 2:98. The toner thus agitated becomes positively charged with a tribo of from about 1.0 to about 1.5 femtocoulombs per milligram. With respect to the "admix" characteristics of this toner, when fresh uncharged toner is added to a blend of toner and carrier prepared in accordance with the above specifications the unchanged toner will typically require over 10 minutes to acquire the same charge as that of the toner particles in the developer since time zero.

The charging characteristics of the toner of Example XXI can also be modulated by the incorporation of surface additives such as silica particles (in an amount of, for example, about 1 percent by weight of the toner particles) such as Aerosil R972 (available from Degussa), zinc stearate (in an amount of, for example, about 0.5 percent by weight of the toner particles), or fine particles of polymethylmethacrylate (in an amount of, for example, about 2 percent by weight of the toner particles). Silica and zinc stearate tend to induce negative charging characteristics and fine polymethylmethacrylate particles tend to induce positive charging characteristics.

The procedure of Example XXI can be used to prepare additional toners with colored silica particles and a diblock copolymer dispersant, wherein any of the colored silica particles prepared in Examples VII through XVI are substituted for the material from Example X. This procedure can also be employed with other diblock copolymers or graft copolymers substituted for PS-b-POE.

Example XXIII

A sample of the toner prepared in Example XVII was melted between glass microscope slides on a Mettler Microscope hot stage. The fused toner composition formed a film which was optically transparent and uniformly blue.

The optical properties of this toner of the present invention were compared to those of a similar toner containing no diblock copolymer as follows. A dispersion of 60 milligrams of colored cyan silica particles in a polystyrene-polyethylene oxide diblock copolymer prepared as described in Example XVII was dispersed in 10 milliliters of tetrahydrofuran by sonication for 20 minutes. To the resulting fine suspension was added 1.0 gram of a copolymer of styrene-butadiene (89/11). The mixture was stirred magnetically for 4 hours, and the resulting suspension was employed to form a film with a Gardner draw coater with a 10 mil gap, with the film being air-dried at room temperature. This film of the composition comprising 94.3 percent by weight styrene-butadiene, 3.8 percent by weight polystyrene-polyethylene oxide diblock copolymer, and 1.9 percent by weight cyan silica particles exhibited properties similar to those observed when the toner was melted to form a film in that it was optically transparent and uniformly blue.

Another film was prepared for comparison purposes as follows. Colored cyan silica particles (20 milligrams) prepared as described in Example X were dispersed in 10 milliliters of tetrahydrofuran by sonication for 20 minutes. To the resulting suspension was added 1.0 gram of a copolymer of styrene-butadiene (89/11). The mixture was stirred magnetically for 4 hours, and the resulting suspension was employed to form a film with a Gardner draw coater with a 10 mil gap, with the film being air-dried at room temperature. This film of the composition comprising 98 percent by weight styrene-butadiene and 2 percent by weight cyan silica particles formed a grainy inhomogeneous film with dark blue domains in a colorless medium. It is believed that a film prepared by melting the toner of Example XVIII will exhibit similarly poor optical characteristics.

These results are illustrative of the enhanced dispersion of colored silica particles achieved in toner formulations containing diblock polymers or graft polymers wherein one segment is polar or hydrophilic, having affinity for the surface of silica particles, and one segment is apolar and miscible with the toner resin.

Other embodiments and modifications of the present invention may occur to those skilled in the art subsequent to a review of the information presented herein; these embodiments and modifications, as well as equivalents thereof, are also included within the scope of this invention.

What is claimed is:

1. A dry toner composition which comprises a resin, hydrophilic silica particles having dyes covalently bonded to the particle surfaces through silane coupling agents, and a polymer having at least one segment capable of adsorbing onto the surface of the silica particles and at least one segment capable of enhancing the dispersability of the silica particles in the resin.

2. A dry toner composition to claim 1 wherein the hydrophilic silica particles have a surface area of from about 50 to about 380 square meters per gram.

3. A dry toner composition according to claim 1 wherein the silane coupling agent is selected from the group consisting of hydroxyalkyl silanes, aminoalkylsilanes, hydroxyalkylaryl silanes, aminoalkylaryl silanes, hydroxyaryl silanes, aminoaryl silanes, and mixtures thereof.

4. A dry toner composition according to claim 1 wherein the coupling agent is selected from the group consisting of aminopropyltriethoxysilane, N,N-(2'hydroxyethyl)-3-aminopropyltriethoxysilane, 4-aminobutyltriethoxysilane, (aminoethyl)-(aminomethyl)-phenethyltrimethoxysilane, N-(2-aminoethyl)-3-aminopropyltrimethoxysilane, p-aminophenyltriethoxysilane, N-(2-aminoethyl)-3-aminopropylmethyldimethoxysilane, 3-aminopropyltrimethoxysilane, 3-aminopropylmethyldimethoxysilane, and mixtures thereof.

5. A dry toner composition according to claim 1 wherein the dye comprises a Reactive Dye.

6. A dry toner composition according to claim 1 wherein the dye is selected from the group consisting of anthraquinones, monoazo dyes, disazo dyes, phthalocyanines, aza[18]annulenes, formazan copper complexes, and triphenodioxazines, to which are covalently attached reactive groups.

7. A dry toner composition according to claim 1 wherein the dye includes a reactive group selected from the group consisting of dichlorotriazines, monochlorotriazines, dichloroquinoxalines, aminoepoxides, mono-(m'-carboxypyridinium)-triazines, 2,4,5-trihalogenopyrimidines, 2,4-dichloropyrimidines, 2,3-dichloroquinoxalines, monofluorotriazines, 4,5-dichloro-6-methyl-2-methylsulfonylpyrimidines, 1,4-dichlorophthalazines, chlorobenzo-thiazoles, sulfatoethylsulfones, β-chloroethylsulfones, 4,5-dichloro-6-pyridazones, α-bromoacryloylamidos, and α,β-dibromopropionylamidos.

8. A dry toner composition according to claim 1 wherein the colored particles comprise from about 65 to about 98 percent by weight of silica, from about 1 to about 20 percent by weight of the coupling agent, and from about 1 to about 30 percent by weight of the dye.

9. A dry toner composition according to claim 1 wherein the colored particles are prepared by a process which comprises reacting hydrophilic silica particles with a silane coupling agent in the absence of water to form particles having covalently attached thereto coupling agents, followed by reacting a dye with the coupling agent.

10. A dry toner composition according to claim 1 wherein the polymer is selected from the group consisting of diblock copolymers, triblock copolymers, and graft copolymers.

11. A dry toner composition according to claim 1 wherein the polymer segment capable of enhancing the dispersability of the silica particles in the resin is hydrophobic with respect to the polymer segment capable of adsorbing onto the surface of the silica particles.

12. A dry toner composition according to claim 1 wherein the polymer segment capable of enhancing the dispersability of the silica particles in the resin comprises monomers selected from the group consisting of acrylic monomers, olefin monomers, ester monomers, amide monomers, urethane monomers, and mixtures thereof.

13. A dry toner composition according to claim 1 wherein the polymer segment capable of enhancing the dispersability of the silica particles in the resin comprises monomers selected from the group consisting of styrene, alkyl styrenes wherein the alkyl group has from 1 to about 20 carbon atoms, halogenated styrenes, vinyl halides, vinyl ethers, vinyl ketones, N-vinyl indole, N-vinyl pyrrolidene, vinyl esters, acrylates, alkylacrylates with the alkyl group having from 1 to about 12 carbon atoms, monoolefins, polyolefins, and mixtures thereof.

14. A dry toner composition according to claim 1 wherein the polymer segment capable of adsorbing onto the surface of the silica particles is hydrophilic with respect to the polymer segment capable of enhancing the dispersability of the silica particles in the resin.

15. A dry toner composition according to claim 1 wherein the polymer segment capable of adsorbing onto the surface of the silica particles comprises monomers selected from the group consisting of cyclic ethers, cyclic esters, cyclic amides, vinyl carboxylic acids, cyclic amines, oxazolines, acrylamides, aldehydes, urethanes, and ureas.

16. A dry toner composition according to claim 1 wherein the polymer segment capable of adsorbing onto the surface of the silica particles comprises monomers selected from the group consisting of cyclic ethers of the formula

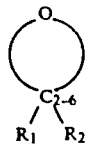

wherein the ring has from about 2 to about 6 carbon atoms and wherein $R_1$ and $R_2$ are selected from the group consisting of hydrogen, alkyl groups with from 1 to about 12 carbon atoms, and aryl groups with from 6 to about 12 carbon atoms; cyclic esters of the formula

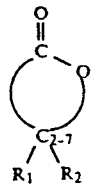

wherein the ring has from about 2 to about 7 carbon atoms in addition to the carbonyl carbon and wherein $R_1$ and $R_2$ are selected from the group consisting of hydrogen, alkyl groups with from 1 to about 12 carbon atoms, and aryl groups with from 6 to about 12 carbon atoms; cyclic amides of the formula

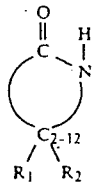

wherein the ring has from about 2 to about 12 carbon atoms in addition to the carbonyl carbon and wherein $R_1$ and $R_2$ are selected from the group consisting of hydrogen, alkyl groups with from 1 to about 12 carbon atoms, and aryl groups with from 6 to about 12 carbon atoms; vinyl carboxylic acids and their corresponding esters of the general formula

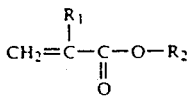

wherein $R_1$ and $R_2$ are selected from the group consisting of hydrogen and alkyl groups with from 1 to about 20 carbon atoms; cyclic amines of the general formula

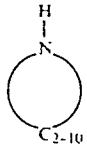

wherein the ring has from about 2 to about 10 carbon atoms; oxazolines of the general formula

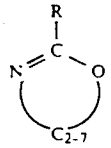

wherein R is selected from the group consisting of hydrogen, alkyl groups with from 1 to about 6 carbon atoms, and benzyl, and the ring has from about 2 to about 7 carbon atoms in addition to the carbon atom situated between the nitrogen and oxygen atoms; acrylamides of the general formula

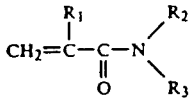

wherein $R_1$ is selected from the group consisting of hydrogen, methyl, or ethyl and $R_2$ and $R_3$ are selected from the group consisting of hydrogen and alkyl groups with from 1 to about 4 carbon atoms; formaldehyde; and acetaldehyde.

17. A dry toner composition according to claim 1 wherein the polymer segment capable of enhancing the dispersability of the silica particles in the resin has a molecular weight of from about 20,000 to about 150,000.

18. A dry toner composition according to claim 1 wherein the polymer segment capable of adsorbing onto the surface of the silica particles has at least two repeating units.

19. A dry toner composition according to claim 1 wherein the polymer segment capable of adsorbing onto the surface of the silica particles has a molecular weight of from about 500 to about 20,000.

20. A dry toner composition according to claim 1 wherein the toner is positively charged.

21. A dry toner composition according to claim 1 wherein the polymer segment capable of adsorbing onto the surface of the silica particles is ionophoric and capable of complexing a salt thereto.

22. A dry toner composition according to claim 21 wherein the ionophoric polymer segment is selected from the group consisting of carbon chain polymers with pendent crown ether groups; polymers of 4'-vinyl benzo 10' crown-6; condensation polymers bearing an in-chain cyclic polyether group; condensation polymers bearing an in-chain cyclic diaza polyether group; condensation polymers bearing an in-chain aza polyether group; open chain polyethers; polyethylene oxide; hydrolized polyethyloxazoline; polymers of acrylic acid monomers; polymers of methacrylic acid monomers; polymers of paracarboxystyrene monomers; polymers of cyclic amine monomers; and polytetrahydrofuran-2,5-diyl of the general formula

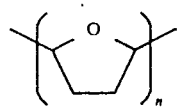

23. A dry toner composition according to claim 21 wherein the ionophoric polymer segment is complexed with a salt in which the cation is selected from the group consisting of alkali metal cations, alkaline earth metal cations, rare earth metal cations, transition metal cations, ammonium cations, and mixtures thereof, and the anion is selected from the group consisting of fluoride, chloride, bromide, iodide, nitrate, perchlorate, thiocyanate, citrate, acetate, picrate, tetraphenyl boride, paratoluene sulfonate, ferricyanide, ferrocyanide, hexachloroantimonate, hexafluorophosphate, tetrafluoborate, and mixtures thereof.

24. A dry toner composition according to claim 21 wherein the ionophoric polymer segment is complexed with a salt, wherein the cation of the salt is complexed to the ionophoric portion of the block copolymer in an amount of from about 0.5 percent to about 100 percent of the possible complexation sites on the polymer.

25. A dry toner composition according to claim 21 wherein the toner is positively charged.

26. A dry toner composition according to claim 21 wherein the tone exhibits an admix time of 60 seconds or less.

27. A developer composition comprising the dry toner of claim 21 and carrier particles.

28. A dry toner composition according to claim 1 wherein the polymer is selected from the group consisting of polystyrene/polyethylene oxide diblock copolymers, polybutadiene/polyethylene oxide diblock copolymers, polystyrene/poly(ethyloxazoline) diblock copolymers, polybutadiene/poly(ethyloxazoline) diblock copolymers, polystyrene/linear polyethylene imine diblock copolymers, polystyrene/polytetrahydrofuran-2,5-diyl diblock copolymers, polybutadiene/-polytetrahydrofuran-2,5-diyl diblock copolymers, polyethylene/polyethylene oxide diblock copolymers, diblock copolymers of carboxy terminated polyesters and polyethylene oxide, diblock copolymers of hydroxy terminated polyesters and polyethylene oxide, polyethylene oxide/polystyrene/polyethylene oxide triblock copolymers, polyethylene oxide/polybutadiene/-polyethylene oxide triblock copolymers, polytetrahydrofuran-2,5-diyl/polystyrene/polytetrahydrofuran-2,5-diyl triblock copolymers, polystyrene/polytetrahydrofuran-2,5-diyl/polystyrene triblock copolymers, graft copolymers with a polystyrene backbone and polyethylene oxide groups pendent from the phenyl groups on the backbone, styrene polyether methacrylate copolymers wherein the methacrylate units are esterified with polyethylene oxide, polyethylene oxide/polypropylene oxide diblock copolymers in which the molecular weight of the polypropylene oxide portion is from about 1,000 to about 3,000 and the polyethylene oxide portion is present in an amount of from about 3 to about 300 moles, polyethylene oxide/polypropylene oxide triblock copolymers in which the molecular weight of the polypropylene oxide portion is from about 1,000 to about 3,000 and the polyethylene oxide portion is present in an amount of from about 3 to about 300 moles, alkyl and alkylaryl ethylene oxides of the general formula

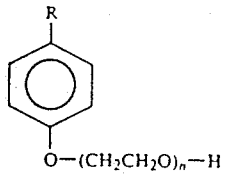

wherein R is an alkyl group with from 1 to about 20 carbon atoms and n is a number of from 1 to about 20, and mixtures thereof.

29. A developer composition comprising the dry toner of claim 1 and carrier particles.

30. A process for generating images which comprises forming a latent image on an imaging member, developing the latent image with the dry toner composition of claim 1, transferring the developed image to a substrate, and affixing the transferred image to the substrate.

31. A process for preparing a dry toner composition which comprises preparing a dispersion in a solvent of hydrophilic silica particles having dyes covalently bonded to the particle surfaces through silane coupling agents, preparing a solution in a solvent of a polymer having at least one segment capable of enhancing the dispersability of the silica particles in the resin and at least one segment capable of adsorbing onto the surface of the silica particles, admixing the silica particle suspension with the polymer solution, thereby resulting in the polymers adsorbing to the surfaces of the silica particles, precipitating the silica particles with the polymers adsorbed thereon from the solution, and admixing the silica particles with the polymers adsorbed thereon with a resin to form a toner composition.

32. A process for preparing a dry toner composition which comprises (1) preparing a dispersion in a solvent of hydrophilic silica particles having dyes covalently bonded to the particle surfaces through silane coupling agents;
(2) preparing a solution in a solvent of a polymer having at least one segment capable of enhancing the dispersability of the silica particles in the resin and at least one ionophoric segment capable of complexing with a salt and capable of adsorbing onto the surface of the silica particles;
(3) preparing a solution of a salt in the solvent;
(4) admixing the salt solution with the polymer solution;
(5) admixing the silica particle suspension with the polymer solution containing the salt solution, thereby resulting in the polymers adsorbing to the surfaces of the silica particles;
(6) precipitating from the solution the silica particles with the polymers adsorbed thereon; and
(7) admixing the silica particles with the polymers adsorbed thereon with a resin to form a toner composition.

* * * * *